US006361432B1

(12) United States Patent
Walker

(10) Patent No.: US 6,361,432 B1
(45) Date of Patent: Mar. 26, 2002

(54) AIR DIFFUSER WITH AIR FLOW REGULATOR

(75) Inventor: Mark A. Walker, Dallas, TX (US)

(73) Assignee: Tomkins Industries, Inc., Dayton, OH (US)

( * ) Notice: Subject to any disclaimer, the term of this patent is extended or adjusted under 35 U.S.C. 154(b) by 0 days.

(21) Appl. No.: 09/376,131

(22) Filed: Aug. 17, 1999

(51) Int. Cl.[7] ..... F24F 13/10
(52) U.S. Cl. ..... 454/290; 454/324
(58) Field of Search ..... 454/185, 186, 454/290, 322, 324, 333

(56) References Cited

U.S. PATENT DOCUMENTS

| | | | | |
|---|---|---|---|---|
| 282,977 A | * | 8/1883 | Gallentine | 454/324 |
| 1,801,568 A | * | 4/1931 | Petrelli | 454/324 |
| 2,470,488 A | * | 5/1949 | Honerkamp et al. | 454/324 |
| 4,145,961 A | | 3/1979 | Lolli | |
| 4,259,898 A | | 4/1981 | Finkelstein et al. | |
| 4,291,615 A | | 9/1981 | Sodec | |
| 4,303,007 A | | 12/1981 | Riegel et al. | |
| 4,449,549 A | | 5/1984 | Weck | |
| 4,508,022 A | | 4/1985 | Finkelstein et al. | |
| 4,523,609 A | | 6/1985 | Weck | |
| 4,549,474 A | | 10/1985 | Fey et al. | |
| 4,890,544 A | | 1/1990 | Aalto et al. | |
| 4,903,894 A | | 2/1990 | Pellinen et al. | |
| 4,934,397 A | | 6/1990 | Niemelä et al. | |
| 5,014,609 A | | 5/1991 | Weck | |
| 5,016,525 A | | 5/1991 | Weck | |
| 5,031,515 A | | 7/1991 | Niemelä et al. | |
| 5,052,284 A | | 10/1991 | Schweikert | |
| 5,054,379 A | | 10/1991 | Sodec | |
| 5,058,490 A | | 10/1991 | Sodec et al. | |
| 5,063,834 A | | 11/1991 | Aalto et al. | |
| 5,069,114 A | | 12/1991 | Sodec et al. | |
| 5,074,198 A | | 12/1991 | Aalto et al. | |
| 5,116,197 A | | 5/1992 | Snell | |
| 5,133,689 A | | 7/1992 | Aalto et al. | |
| 5,146,764 A | | 9/1992 | Bauman et al. | |
| 5,180,331 A | | 1/1993 | Daw et al. | |
| 5,220,910 A | | 6/1993 | Aalto et al. | |
| 5,312,296 A | | 5/1994 | Aalto et al. | |
| 5,556,330 A | | 9/1996 | Schweikert | |
| 5,938,525 A | | 8/1999 | Birdsong et al. | 454/290 |

FOREIGN PATENT DOCUMENTS

| | | | | |
|---|---|---|---|---|
| DE | 455384 | * | 2/1928 | 454/324 |
| JP | 2-136644 | | 5/1990 | |

OTHER PUBLICATIONS

Krantz, Underfloor Air Supply System. Technical Manual dated Jan. 14, 1991.
Titus Diffuser, Access Floor Air Distribution Systems. Product Brochure, 1996.
Trox Technik, Floor Diffusers Type FB in aluminum and plastic. Technical Manual, 1991.

* cited by examiner

*Primary Examiner*—Harold Joyce
(74) *Attorney, Agent, or Firm*—Calfee, Halter & Griswold LLP

(57) ABSTRACT

A diffuser adapted to regulate air flow from an underfloor air distribution system. A grille sits on a dust receptacle or basket-shaped housing that is supported by a mounting assembly in the floor. A flow regulator or damper nests inside the housing. Both the housing and the flow regulator have air slots extending through their side walls. Air from the underfloor air plenum passes through these slots into the diffuser and is forced through helical slots in the grille into the room above the diffuser. The air flow rate can be adjusted by rotating the flow regulator within the housing so that the slots in the flow regulator are either in or out of registry with the slots in the housing. The flow regulator can be rotated by turning the grille. The grille and mounting assembly have indicators that give a visual indication of the position of the flow regulator with respect to the housing, the opening of the slots, and the flow rate through the diffuser.

9 Claims, 9 Drawing Sheets

AIR DIFFUSER WITH AIR FLOW REGULATOR

FIELD OF THE INVENTION

The invention relates to an air diffuser designed to regulate air flow from an underfloor air distribution system.

BACKGROUND

Underfloor air distribution has gained popularity in work environments due to its design flexibility and reconfiguration capabilities. While early underfloor air distribution systems were designed for spaces housing large computer systems, the increased use of local area networks and telecommunication systems are requiring entire buildings to be designed with underfloor air distribution systems that provide large quantities of cooling air. Also, with the trend to more frequent office reorganization, flexible offices with electrical and mechanical systems that can be easily reconfigured at minimum cost to accommodate personnel and hardware requirements are in increased demand.

Bottom source or underfloor air distribution systems typically include a number of small diffusers that can be moved to accommodate frequent changes in space usage and the resulting changes in ventilation requirements. The diffusers are usually mounted in a raised floor that defines the top surface of a plenum chamber. In other words, the space beneath the floor panels constitutes an enclosed plenum chamber or air space in which the air pressure is greater than in the room or other enclosure to be heated, cooled or ventilated. Air flows from the plenum chamber through the diffusers into the room or other enclosure. For optimal performance, diffusers should expel air in a swirling air pattern with little or no turbulence and, to prevent drafts, relatively low jet velocities. This pattern promotes high induction or entrainment rates that mix unconditioned air within the room with the air being supplied through the diffusers, thereby providing comfortable air movement and eliminating or reducing air stagnation and stuffiness.

One known underfloor air distribution system, produced by Krantz, is an injection molded device consisting of a diffuser grille, a damper, a basket, a trim frame and a retaining frame. The damper is placed within the basket, and the grille is placed on top of the damper. The damper and basket may have slotted side walls so that air flow into the air distributor can be controlled by rotating the damper. The grille may be connected to the damper, for example, with pins which extend from the upper edge of the damper into slots in the grille, so that the damper may be rotated by rotating the grille. The basket is inserted into the trim frame, which is inserted into the retaining frame. The retaining frame, in turn, can be affixed to flooring panels for access to the underfloor air plenum supply. The grille is designed with a circular configuration and has air slots which extend radially from the center of the grille to the outside edge of the grille. The slots can vary in length and width, but have a uniform slope.

SUMMARY OF THE INVENTION

The present invention provides a diffuser adapted to regulate air flow from an underfloor air distribution system. In the preferred embodiment, the diffuser has a grille with slots, extending generally outward from the center of the grille, that produce a swirling air flow pattern with high induction. The grille sets on a dust receptacle or basket-shaped housing that is supported by a mounting assembly in the floor. A flow regulator or damper nests inside the housing. Both the housing and the flow regulator have air slots extending through their side walls. Air from the underfloor air plenum passes through these slots into the diffuser and is forced through the helical slots in the grille into the room above the diffuser. The air flow rate can be adjusted by rotating the flow regulator within the housing so that the slots in the flow regulator are either in or out of registry with the slots in the housing. The flow regulator has a series of pins that project into grille slots. Thus, the flow regulator can be rotated by turning the grille.

The outer rim of the housing, on which the grille rests, and the outer surface of the grille have mating rings of shallow, generally V-shaped teeth. The grilles will not rotate if a weight such as a person or a piece of furniture is on the diffuser, but the teeth are designed to allow the grille to be rotated, thereby adjusting the air flow rate, with gentle manual pressure.

The mounting system for the diffuser includes a trim ring that extends through a hole in the floor and a retaining ring. The trim ring has a rim that rests on the floor. The retainer ring is shaped so that it can be dropped through the hole in the floor and then pulled up onto the trim ring, with the floor gripped between the retaining ring and the rim of the trim ring. The preferred retainer ring is movably fixed to the trim ring by a ratchet-like latching mechanism that allows the retainer ring to be rotated about and onto the trim ring. This accommodates various thicknesses of flooring panels. Once the trim ring is properly positioned, the retainer ring is ratcheted onto the trim ring to securely attach the diffuser to the floor.

The grille and the trim ring, or another stationary component of the diffuser that is mounted above the floor, have first and second indicators, respectively, that provide a visual indication of the position of the regulator. One of these indicators may be a pointer and the other may provide an approximate indication of the volumetric flow rate through the diffuser at different positions of the flow regulator. The relationship of one indicator to the other gives the user an immediate visual indication that the regulator is fully closed, fully open or at some intermediate position.

Other features and advantages to this invention will be apparent from the following description.

DRAWINGS

Figure 10A:
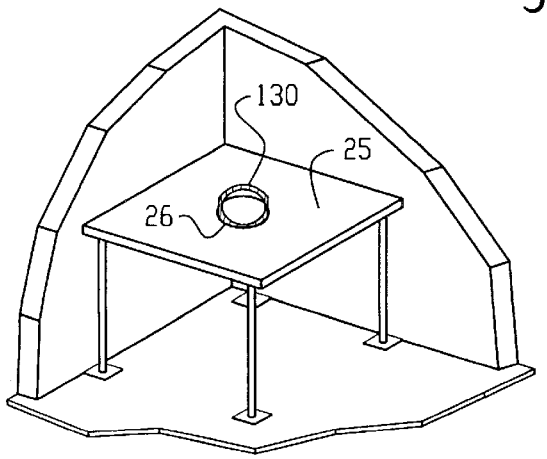
Figure 10B:
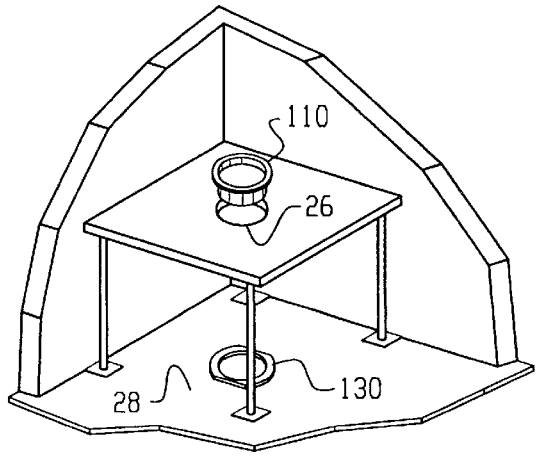

FIGS. 10*a* and 10*b* are schematic perspective views, showing the installation of the trim ring and retaining ring in the floor of an underfloor air distribution system.

Figure 11:
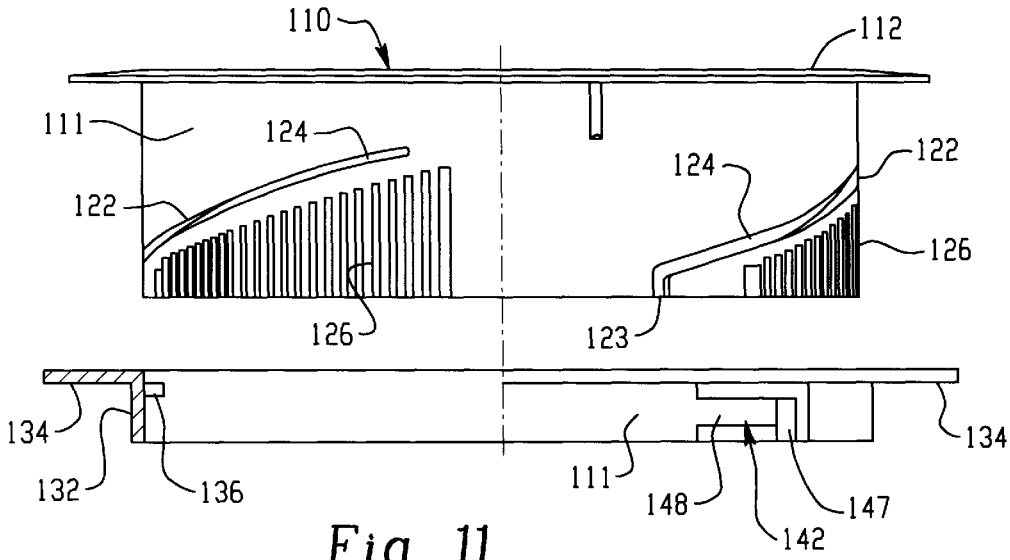

FIG. 11 is an exploded, partially sectioned side elevation view of the trim ring and retaining ring.

Figure 12:
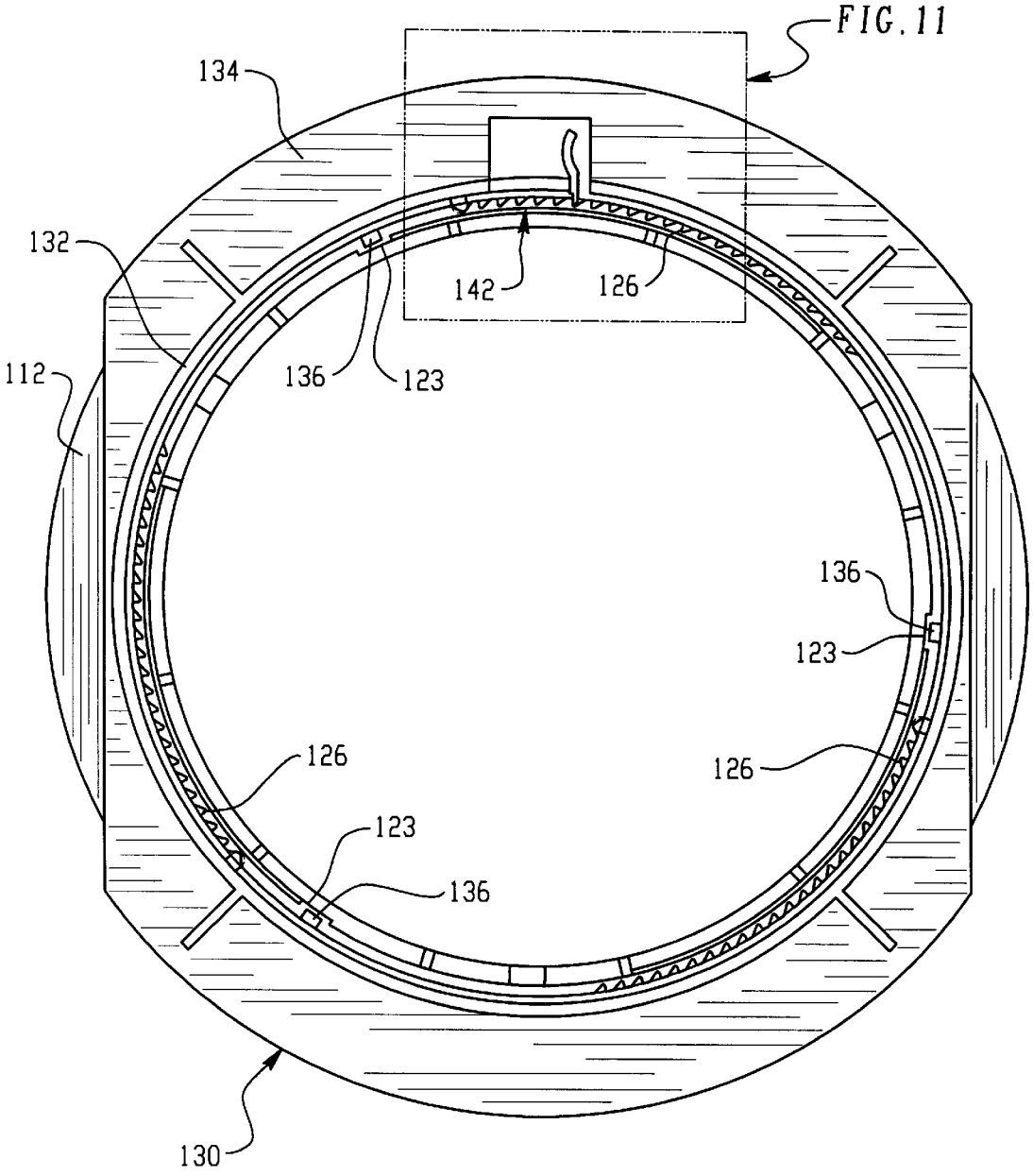

FIG. 12 is a bottom plan view of the trim ring and retainer ring.

Figure 13:
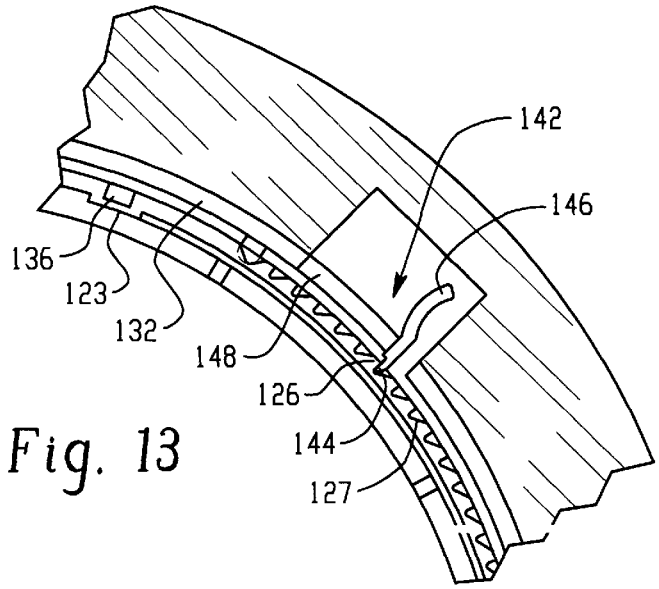
Figure 14:
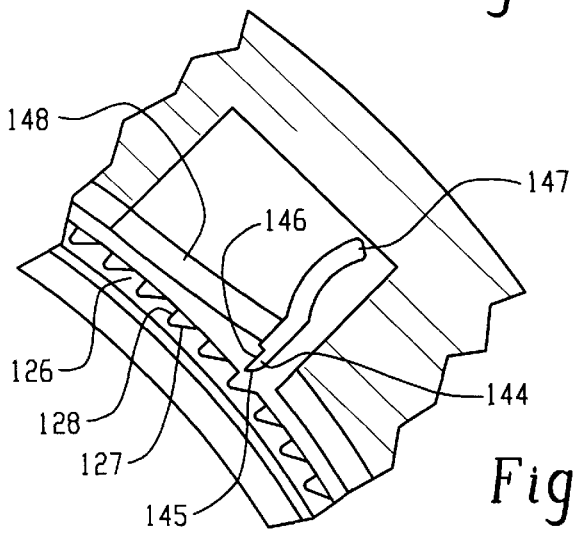

FIG. 13 is an enlarged detail view of the ratcheting mechanism in FIGS. 14 and 16.

FIG. 14 is a still further enlarged detail view of the ratcheting mechanism, showing how the locking tooth is moved for removal of the retaining ring.

Figure 15A:
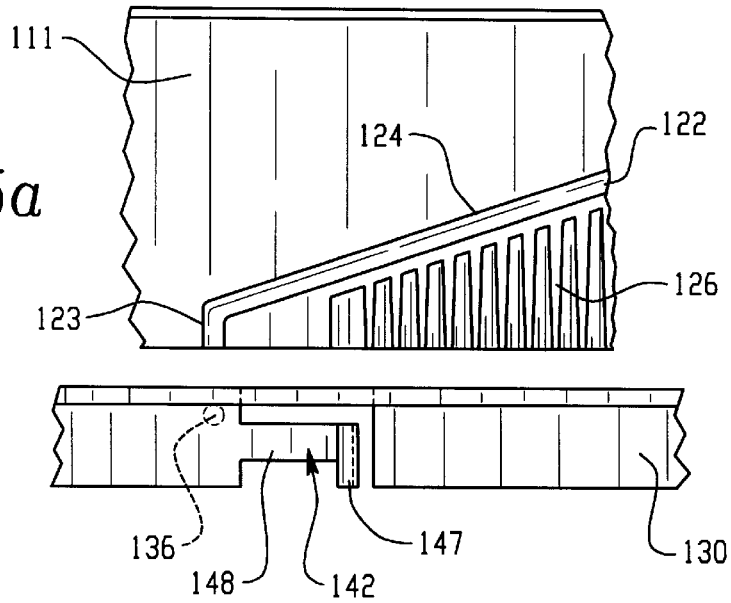
Figure 15B:
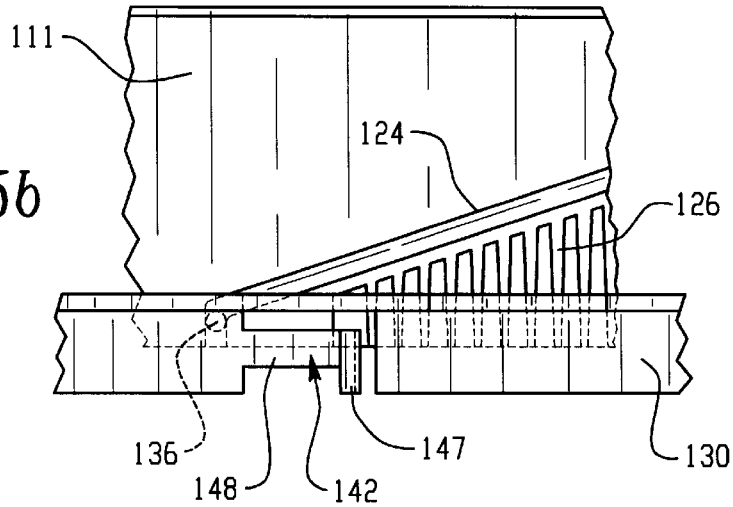
Figure 15C:
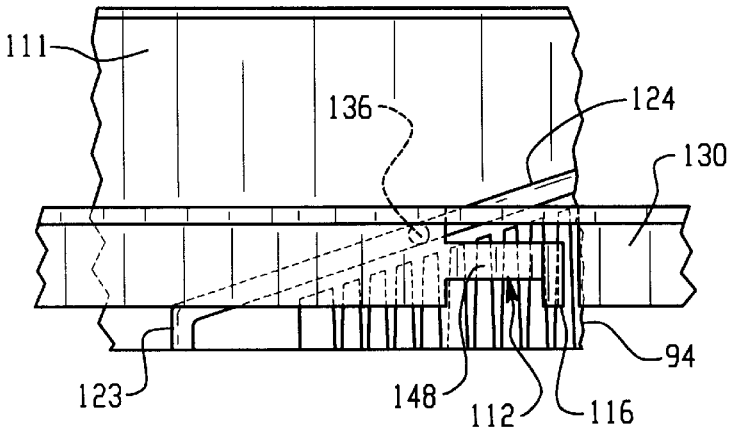

FIGS. 15*a*, 15*b* and 15*c* are fragmentary side elevation views of the trim ring and retaining ring, illustrating the assembly of these components.

DETAILED DESCRIPTION

Figure 1:
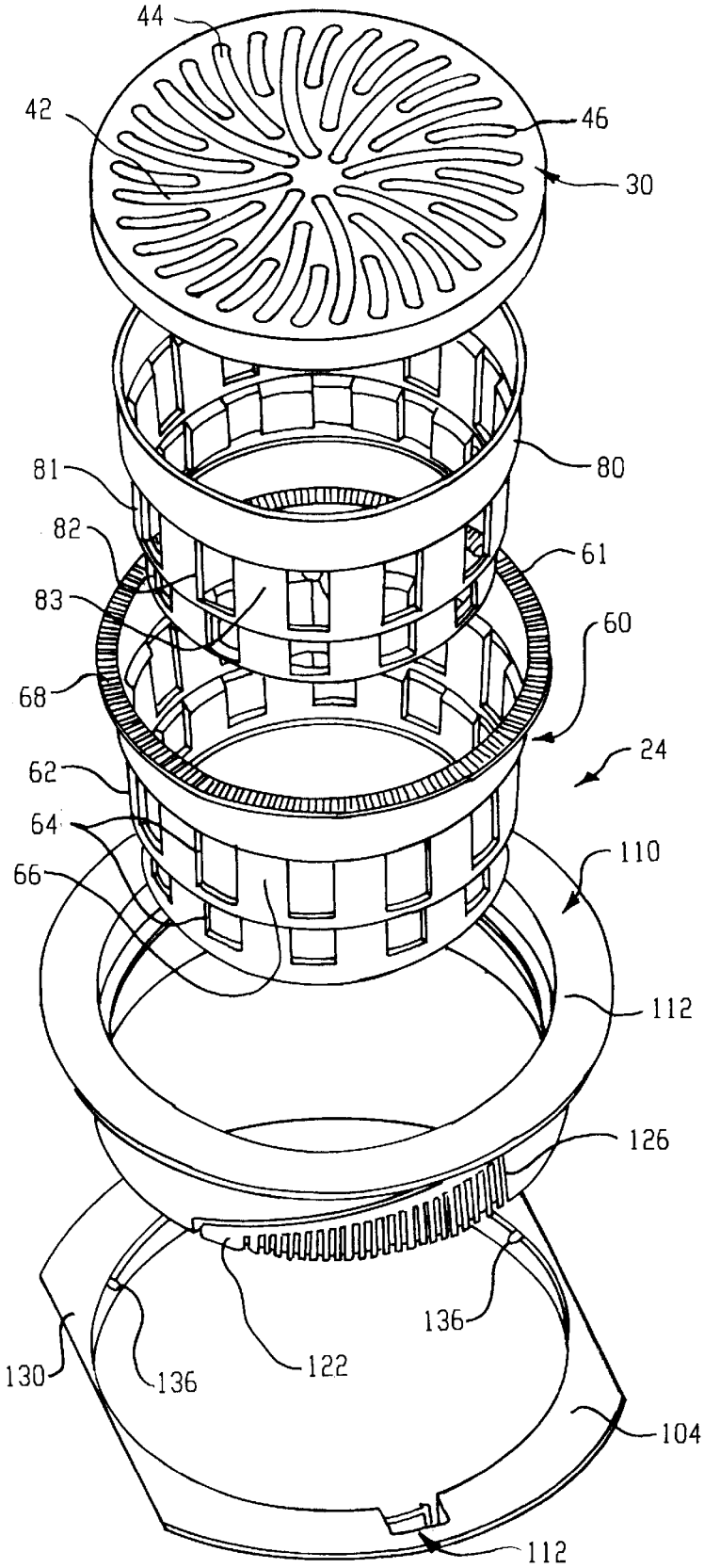
FIG. 1 is an exploded perspective view of an underfloor air diffuser embodying this invention.

FIG. 1 is an exploded perspective view of an underfloor air diffuser embodying this invention. The diffuser, referred to generally as 24, has a grille 30 supported by a basket-shaped dust receptacle or housing 60. Housing 60 is mounted in the floor 25 above the plenum of the air distribution system by a trim ring 110 and a retaining ring 130, shown is FIGS. 10*a* and 10*b* and described in more detail below.

Figure 2:
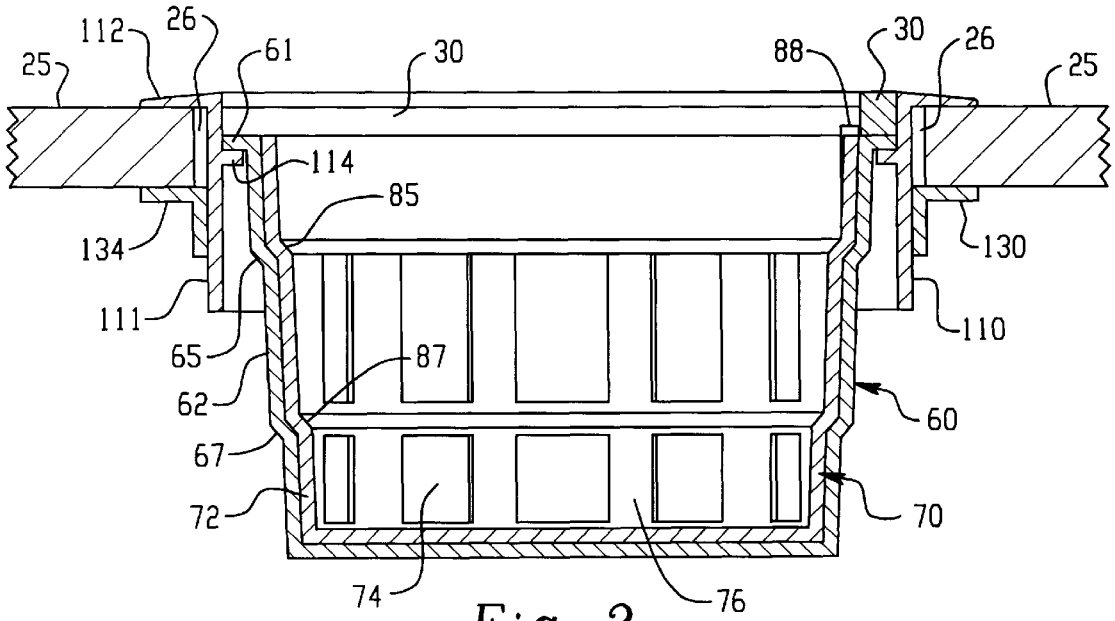
FIG. 2 is a partially sectioned elevation view of the diffuser in FIG. 1, installed in the floor panel of an underfloor air distribution system.
Figure 6:
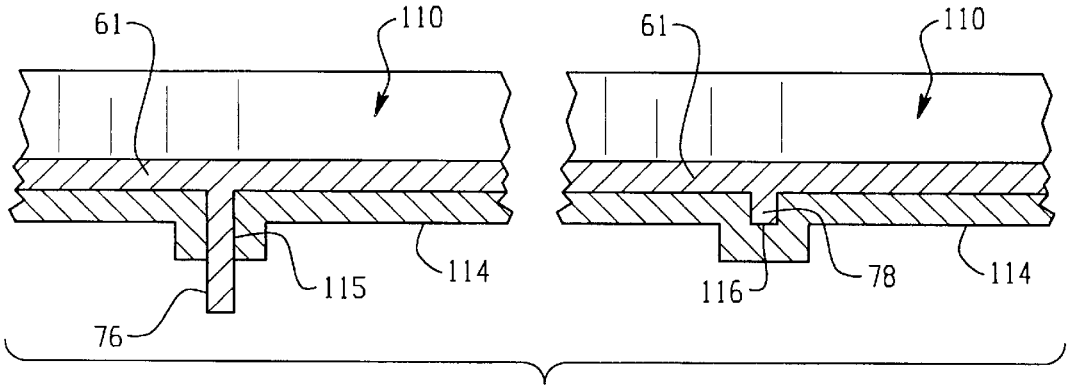
FIG. 6 is a further enlarged, fragmentary cross sectional view through the housing, flow regulator and mounting ring for the diffuser.

A flange 61 around the top of housing 60, shown as FIG. 2, rests on an annular shoulder 114 inside trim ring 110. As shown in FIG. 6, a series of locator tabs 76, 78 extend from the bottom of flange 61. One of the locator tabs 76, which is longer than the others, is inserted through an open slot 115 in annular 114. This ensures that the basket is properly oriented with respect to the trim ring. The other locator tabs 78 fit into closed notches 116 in annular shoulder 114.

Figure 5:
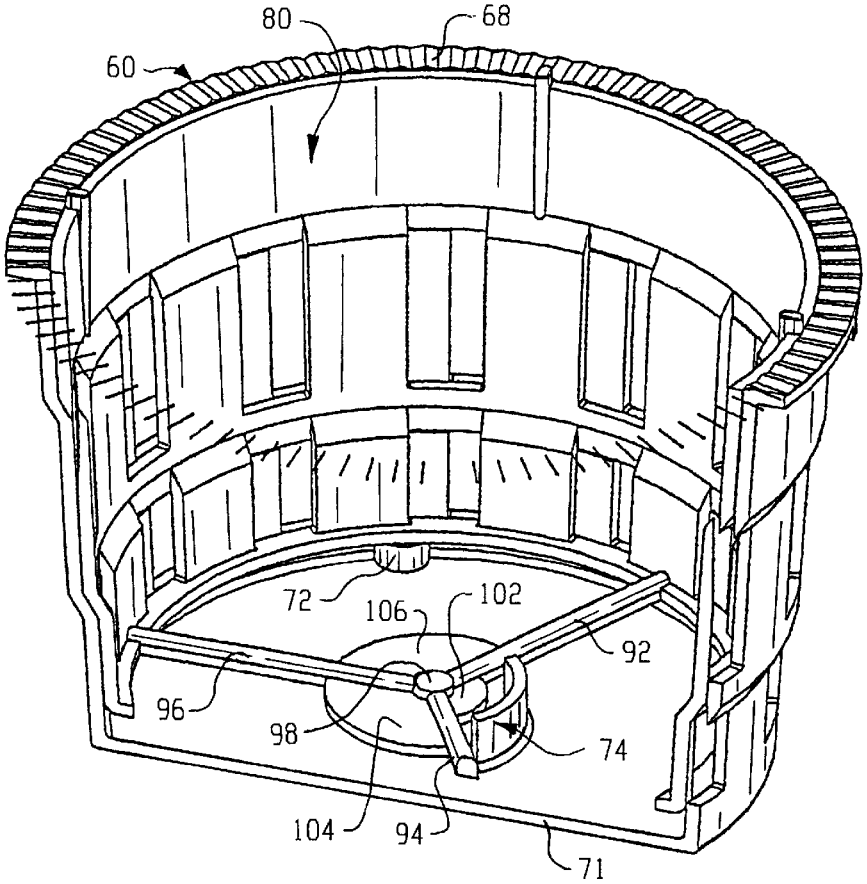
FIG. 5 is an enlarged, partially cut away perspective view of the housing and flow regulator or damper for the diffuser shown in FIG. 1.

A flow regulator or damper 80 nests inside the basket shaped housing 60. The side walls 81 of flow regulator 80 and the side walls 62 of housing 60 are complementary surfaces of revolution, such as stepped, slightly tapered cylinders or truncated cones, that allow the side walls 81 of the flow regulator to contact and rotated with respect to the side walls 62 of the housing. The flow regulator illustrated in FIG. 2 has an upper sloping shoulder 85 and a lower sloping shoulder 87 that rest on sloping shoulders 65 and 67 in housing 60. The upper and lower pairs of sloping shoulders 85, 65 and 87, 67 providing mating surfaces that reduce surface contact and allow the flow regulator to rotate easily within the housing. FIG. 5 illustrates an alternative arrangement with a series of support pads 72 spaced around the outside of the base 71 of the housing The side walls 62 of housing 60 and the side walls 81 of flow regulator 80 have mating longitudinally extending air slots 64, 82, separated by solid portions 66, 83 of their respective side walls 62, 81. When the flow regulator is rotated so that the slots 82 in the flow regulator are in registry with the slots 64 in housing 60, air can flow from the underfloor air plenum into the diffuser. This flow can be reduced or stopped by rotating the flow regulator 70 so that solid portions 83 of the flow regulator side walls 81 partially or totally cover the air slots 64 in the housing.

The illustrated housing and flow regulator each have twelve equally spaced slots 64, 82 above the lower step or shoulder in the side walls 62, 81 and a similar set below the step. The arcuate width of the solid sections 73, 83 of the housing side wall 62 and regulator side wall 81 are substantially equal to the arcuate width of the slots 64, 82 in the side walls 62, 81. In the illustrated housing and flow regulator, each of the twelve slots in the housing side wall, each of the twelve slots in the regulator side wall and each of the solid side wall sections that separate these slots has an arcuate width of approximately 15°. The regulator can be moved from a fully opened position to a substantially closed position by rotating the regulator by a distance equal to the width of one slot, or approximately 15°.

Vertical tabs or pins 88 protrude from the upper rim 89 of air flow regulator 80, extending above the top of housing 60 into air slots 42, 44 or 46 in the grille 30. The pins 88 are spaced to correspond to the spacing of the slots in the grille, so that each pin will engage one of the air slots whenever the grille is placed on the housing 60 and flow regulator 80. When the grille is rotated, an inner wall of an air slot engages each of the pins, and the flow regulator is rotated with the grille. As the flow regulator rotates within housing 60, the air slots 82 in the side walls of the flow regulator and the solid portions 83 of the flow regulator side walls open and close the air slots 64 in the side walls of the housing. Thus, the air flow from the plenum through the diffuser can be controlled by simply rotating the grille by hand.

FIG. 5 illustrates stops that limit rotation of flow regulator 80 with respect to housing 60. The flow regulator has a series of three equally spaced arms or stops 92, 94, 96 that extend inwardly from the side walls of the flow regulator and are joined at a central hub 98 located at or near the central axis of rotation of the flow regulator. When the flow regulator is installed in the housing, an arcuate, molded-in tab or stop 74 extends upwardly from the base 71 of the housing between the first bar 92 and second bar 94. The arcuate width of tab 74 is approximately 15° less than the arcuate width of the space between first bar 92 and second bar 94. Thus, these stops permit the flow regulator to move through an arc of approximately 15°, substantially equal to the width of the slots in the housing and regulator side walls. Arms 92 and 94 and tab 74 limit rotation of the regulator to a range wherein the slots are fully open at one end of the range of motion and fully closed at the other. As will be seen below, this facilitates using the rotation of the flow regulator to provide a visual indication of the position of the flow regulator with respect to the housing, the opening of the slots, and the flow rate through the diffuser.

First bar 92 is separated from third bar 96 by a wedge-shaped reinforcing segment 106. Second bar 94 is connected to third bar 96 by a similar wedge-shaped reinforcing segment 104. A smaller wedge-shaped reinforcing segment 102 connects first bar 92 to second bar 94. This smaller segment 102 permits the flow regulator 80 to drop into the desired position in housing 60, with the tab or stop 74 on the bottom of the housing extending up between the first and second arms 92, 94. If one were to attempt to insert the flow regulator into the housing with tab 74 between the first and third arms 92, 96, or the second and third arms 94, 96, the larger reinforcing segments 104, 106 would prevent the regulator 80 from fully entering the housing 60.

Figure 7:
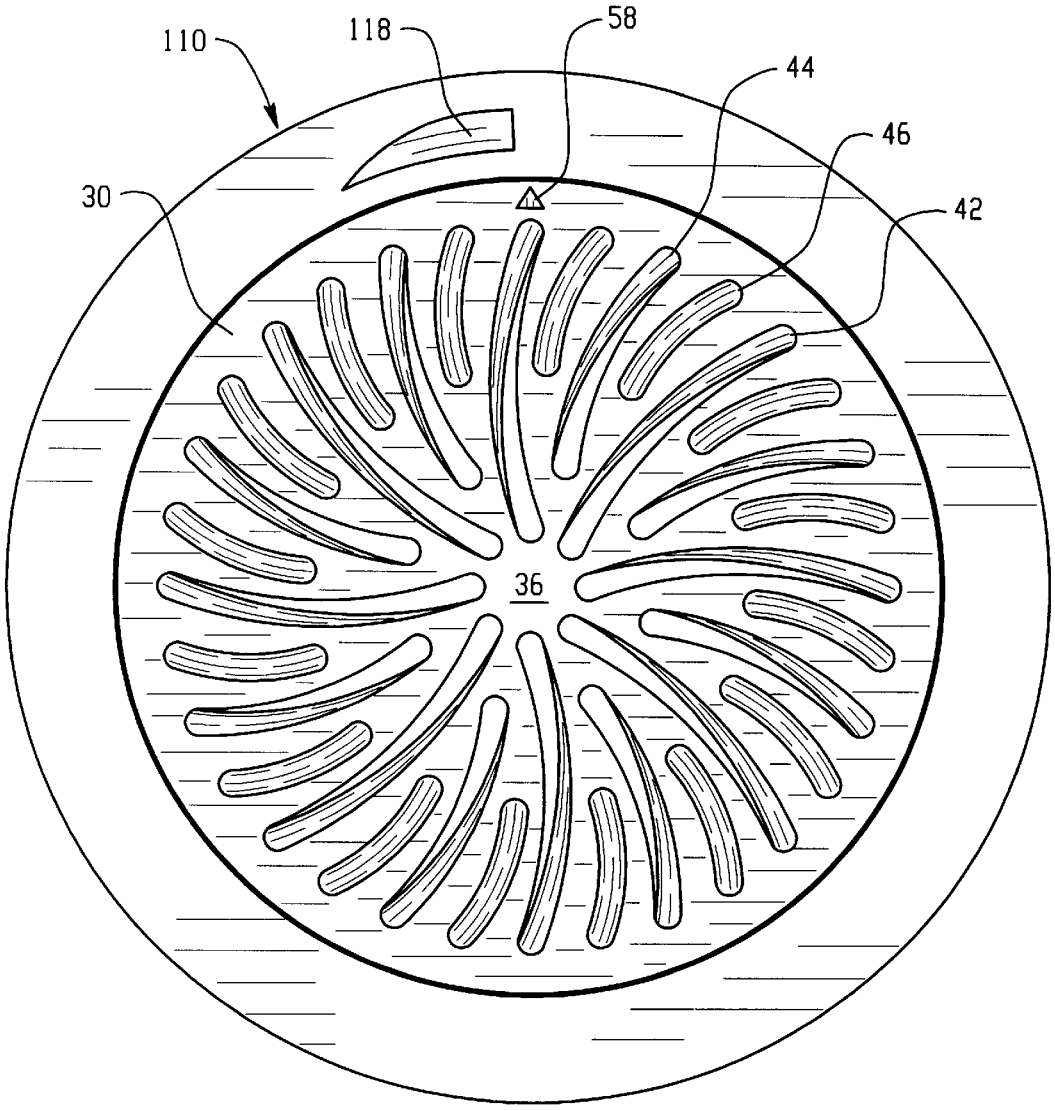
FIG. 7 is a top plan view of the grille and the trim ring in which it is mounted.

As shown in FIG. 7 there is a first indicator 58 in the form of a small triangle or pointer near the outer rim of grille 30, and a second indicator 118 on the trim ring within which the grille is mounted. The second indicator 118 has an arcuate width of approximately 15°. This is substantially equal to the arcuate distance traveled by the flow regulator in moving from fully closed to fully open. Thus, if indicator 58 is positioned at the left hand end of indicator 118, with the flow regulator slots in the closed position, and the grille is rotated to move the flow regulator to the fully open position, indicator 58 will be at the right hand side of indicator 118. Indicator 118 is shaped to provide an approximate indication of the volumetric flow rate through the diffuser as the flow regulator moves from the closed to the open position. Indicator 118 and indicator 58 cooperate to give an approximate indication of the air flow through the diffuser at any position of the flow regulator.

The diffuser is assembled by mounting the housing and flow regulator in the trim ring. The relative positions of the slots in the flow regulator and housing are observed or adjusted, and the grille is then placed atop the flow regulator and housing, with the pins 88 that extend from the upper rim 89 of the regulator in the appropriate grille slots and indicator 58 in a position, relative to indicator 118, that corresponds to the position of the regulator slots. This positions the indicators to function as described above.

Figure 3:
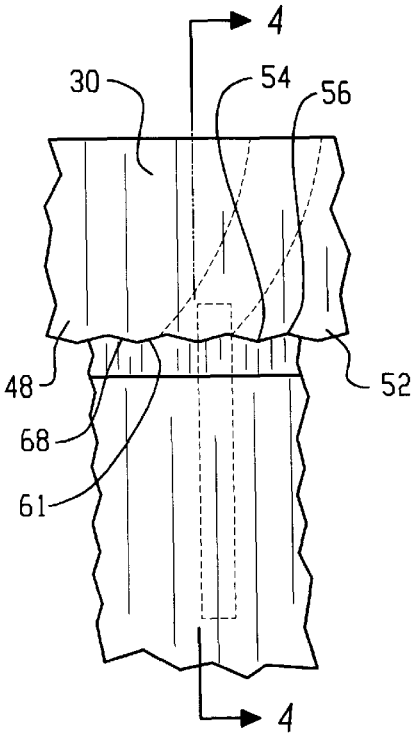
FIG. 3 is an enlarged detail view, along lines 3—3 of FIG. 4, of the rims of the grille and the housing on which it rests, showing the teeth between the grille and housing.

As may be seen in FIG. 3, there is a ring of shallow, V-shaped teeth 48 around the outer edge of the bottom of grille 30. A mating ring of teeth 68, shown in FIGS. 1, 3 and 5, extends laterally around the flange 61 at the top of housing 60. Grille 30 rests on flange 61, and the teeth 48 on the bottom of the grille mesh with the teeth 68 on the top of the flange. The sides 52 of the illustrated teeth 48, 68 define angles of about 15° at the tips 54 and bases 56 of the teeth 48, 68. This shallow angle allows the grille to be rotated with gentle pressure on the top of the grille, thereby rotating flow regulator 80 and opening or closing the air slots 64 in housing 60. Thus, the flow rate can be adjusted quickly without removing the grille. However, when a greater force such as the weight of a piece of furniture or a person is placed on the grille, the teeth 48, 68 lock the grille and prevent inadvertent movement.

Air is discharged from the diffuser through slots 42, 44, and 46 in grille 30. Unlike conventional grilles for this type of underfloor diffuser which, because of manufacturing limitations, have generally had straight slots, the grilles of this invention have a pattern of curved, helical slots extending generally inwardly from near the outer rim of the grille 30, with the longest slots 42 terminating at the central hub 36 of the grille. These long slots 42 are separated from each other by medium length slots 44 and short slots 46. This pattern facilitates production of a grille with slots comprising a relatively high percentage of its face, while maintaining desired structural integrity. When constructed of an engineered plastic, the illustrated grille, with slots covering more than 20% of the surface of the grille, is capable of supporting loads in excess of 1400 lbs., which makes it entirely suitable for use in a floor.

Figure 8:
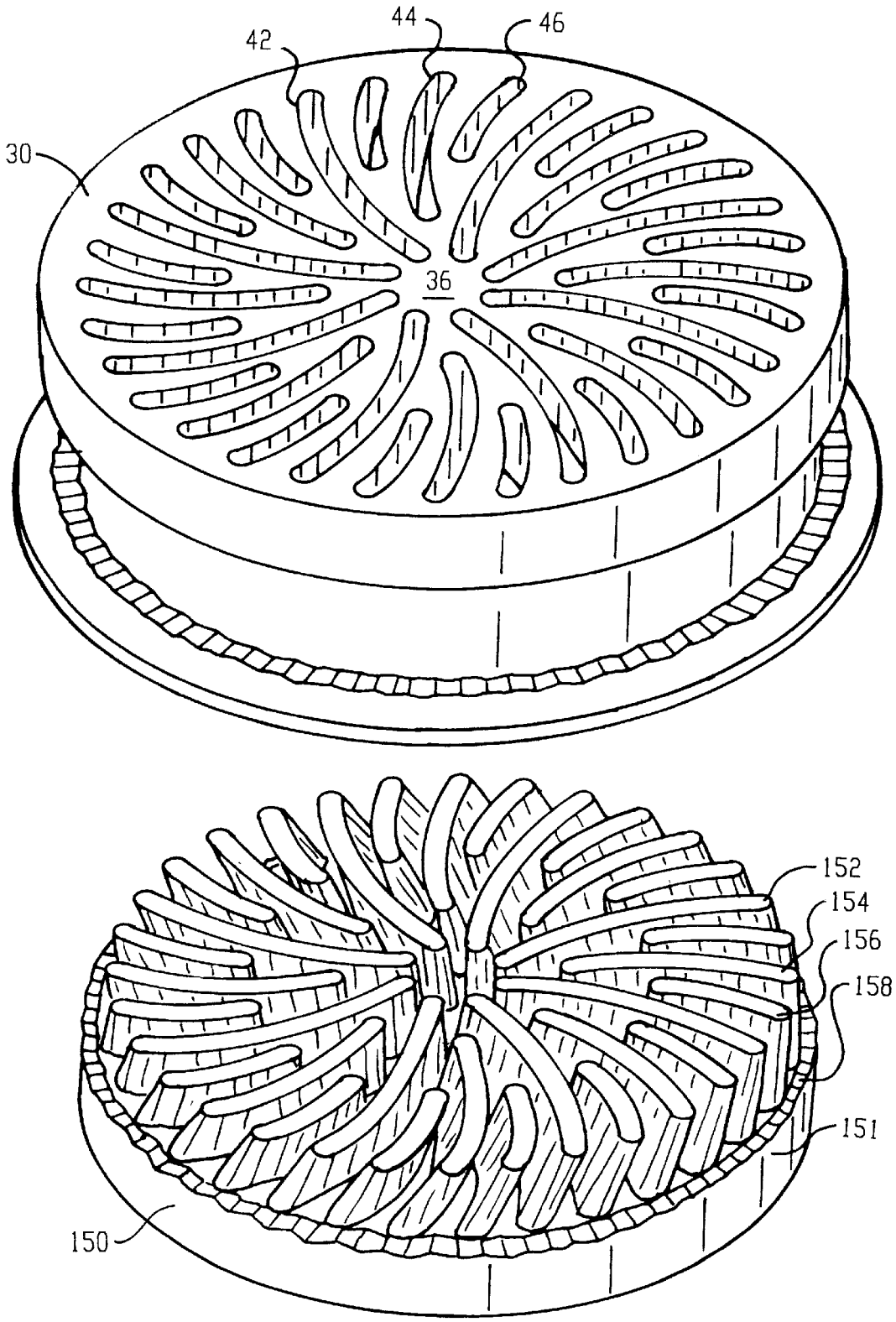
FIG. 8 is an exploded perspective view of the grille, the mold core on which it is produced, and a mating collar ring used to remove the grille from the mold core.
Figure 9:
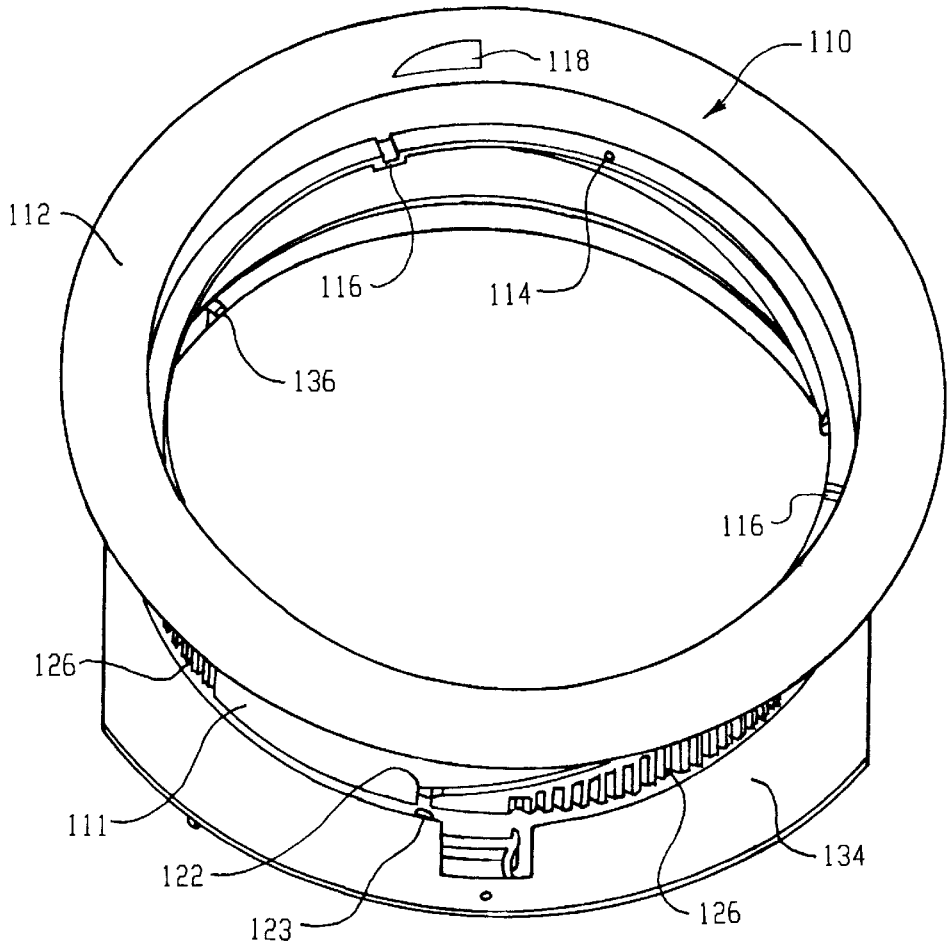
FIG. 9 is a perspective view of the trim ring and retaining ring in FIG. 1, illustrating the ratcheting mechanism that holds them together, so that the diffuser is secured in a hole in a floor panel as shown in FIG. 2, yet allows them to be separated so that the diffuser can be moved.

The slots in the grille are sloped so that the sides of the slots function as air deflectors that help provide the desired flow pattern. The curvature and slope of the slots provide a swirling air flow with low jet velocities, low impulse, minimal turbulence and high induction. As shown in FIG. 8, the slots are produced in an injection mold with a mold core 180 with an intricate pattern of core pins 152, 154, 156, extending from a base 152. Specific feature of the mold and grille, and the process for molding the grille, are described in more detail in co-pending application Ser. No. 08/899,345, filed Jul. 23, 1997 by John Birdsong and Kennon Porter, the disclosure of which is incorporated herein by reference.

As shown in FIGS. 2, the diffuser 24 is designed to be mounted, with the trim ring 110 and retaining ring 100 illustrated in FIGS. 9–15, in a hole 26 in the floor 25 above an air distribution plenum. The trim ring and retaining ring are designed so that the entire installation process can be performed from above the floor, which shortens installation and relocation of the diffusers substantially. This diffuser can be installed in less than 1 minute, whereas installation of prior art diffusers that required parts of the installation to be performed from beneath the floor typically required at least 5 minutes. In an office building with many diffusers, the time savings are significant.

Trim ring 110 has a cylindrical section 111 that extends through the hole 26 in the floor, and a tapered flange 112, extending laterally from the top of cylindrical section 111, that is larger than the hole in the floor. The surface of cylindrical section 111 has three series of latching teeth 126 and three camming grooves 122 that hold the trim ring and retaining ring together in the installed position. Retaining ring 130 has a cylindrical section 132 whose inner diameter is slightly larger than the outer diameter of the cylindrical section 111 of the trim ring. A flange 134 extends from the upper end of the cylindrical section 132 of the retaining ring and, as seen in FIG. 2, presses against the bottom of floor 25 in the installed position. Flange 134 differs from the flange 112 on the trim ring in that it does not have a uniform diameter or width. In one direction flange 134 is longer than the width of the hole 26 in which it is to be installed. Thus, the flange spans the hole and holds the diffuser in place. In another direction, as best seen FIG. 12, the width of flange 134 is only slightly greater than the outer diameter of the cylindrical section 132 of the retaining ring, and less than the width of hole 26. This means that the retaining ring can be slipped through the hole in the installation process, and the entire process can be performed from above the floor.

Three pins 136, which may be seen in FIGS. 9, 11–13, 15*a*, 15*b*, and 15*c*, extend from the inner surface of retaining ring 130. As best seen in FIGS. 15*a*, 15*b*, and 15*c*, these pins 136 are positioned to enter vertically extending mouths 123 of the camming grooves 122 on the trim ring when the retaining ring is placed on the bottom of the trim ring. When the pins reach the top of the vertically extending mouths of the camming grooves, the retaining ring may be rotated with respect to the trim ring and the pins 136 ride up inclined spiral sections 124 of camming grooves 122, pulling the retaining ring onto the trim ring until it reaches the installed position shown in FIG. 2.

Retaining ring 130 has a latching mechanism 142 that engages one of the series of latching teeth 126 on the trim ring. Latching mechanism 142 has a latch tooth 144 that engages the teeth 126 on the trim ring, a release tab 147 used to disengage the latch tooth 144 from teeth 126, and a resilient arm 148, extending from the cylindrical section 132 of the retaining ring, on which the latch tooth and release tab are mounted. There is an opening in the retaining ring flange 134 at the latching mechanism to facilitate access.

As the retaining ring is rotated onto the trim ring, the latch tooth engages the teeth on the trim ring and locks the retaining ring in place. As best seen in FIGS. 13 and 14, the leading sides 127 of the trim ring teeth 94, i.e. the sides that are contacted first by the latch tooth 144 as the retaining ring rotates onto the trim ring, and the leading side 145 of latch tooth 144, are sloped or beveled to allow the latch tooth to pass over the trim ring teeth in the installation process. The trailing sides 128 of the trim ring teeth and the trailing side 146 of the latch tooth are substantially at right angles to the direction of movement of the latch tooth to reduce the risks of inadvertent release.

Figure 4:
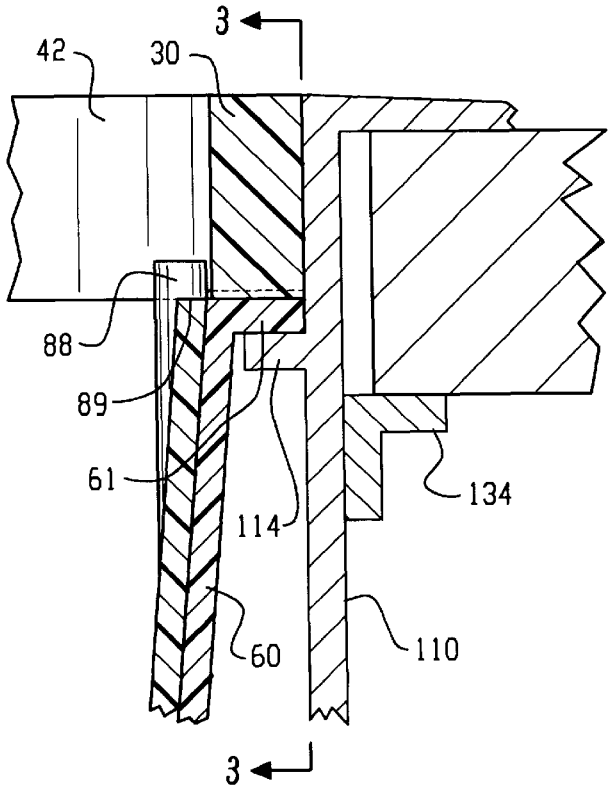
FIG. 4 is an enlarged cross-sectional view, along lines 4—4 of FIG. 3, showing the connection between the grille and flow regulator in the diffuser in FIGS. 1 and 2.

The trim ring and retaining ring can be installed quickly and easily from above the floor, a marked advantage over the processes required with earlier underfloor diffusers. As shown in FIG. 10*a*, the retainer ring 130 is inserted through the hole 26 in floor 25 and allowed to rest on the bottom of the plenum 28. The trim ring 110 is then placed in hole 26, as shown in FIG. 10*b*. The installer reaches through the central opening in the trim ring, picks up the retainer ring, inserts the retaining ring pins 136 into the vertically extending mouths 123 of the trim ring camming grooves, and rotates the retaining ring to move pins 136 up the inclined spiral sections 124 of the camming grooves and pull the retaining ring up the trim ring until the floor is gripped securely between the trim ring flange 112 and the retaining ring flange 134. With the trim ring and retaining ring secured in place, housing 60 is placed inside the trim ring. As shown in FIGS. 2 and 4, the flange 61 at the top of housing 60 rests on an annular shoulder 114 that extends from the inside wall of trim ring 110. The flow regulator 80 is placed inside the housing, the grille 30 is placed on top, and the unit is ready for service. The entire installation process can be performed in less than one minute, which is substantially less than the time required for previous underfloor diffusers.

The diffuser can be removed just as easily. The grille, flow regulator and dust basket are removed. The worker then reaches through the central opening in the trim ring and grasps the release tab 147 on the retaining ring locking mechanism. As shown in FIG. 14, pulling back on the release tab flexes arm 148 and allows the latch tooth 144 to clear the teeth 126 on the trim ring 80 so that the retaining ring can be rotated back off the trim ring.

As may be seen from the foregoing description, the diffusers of this invention provide an effective, flexible and adaptable system for distributing air from an underfloor distribution system or similar plenum, they provide a swirling air flow with low jet velocities, low impulse, minimal turbulence and high induction. The diffusers are easily installed and easily relocated. The flow rate through individual diffusers can be easily adjusted and the diffusers provide a simple and economic but relatively accurate indication of the flow rate through them. Of course, the embodiment described above is merely illustrative. Those skilled in the art will readily appreciate that many modifications may be made to this diffuser within the scope of this invention, which is defined by the following claims.

Having thus described the invention, I claim:

1. An air diffuser comprising:

a housing comprising a first surface of revolution with apertures in said surface;

a flow regulator comprising a second surface of revolution that is complimentary to said first surface, said second surface having apertures that are positioned to move into and out of registry with the apertures in said first surface when said flow regulator is rotated with respect to said housing, so that the apertures in said first surface and the apertures in said second surface may be opened or closed by rotating the flow regulator;

one or more housing stops mounted on the housing and one or more regulator stops mounted on the flow regulator, said stops on said flow regulator being designed and positioned to engage the stops on the housing and limit rotation of said regulator with respect to said housing so that said apertures are substantially fully open at a first end of a range of rotation of said flow regulator and are substantially fully closed at a second end of said range of rotation;

a grille supported by and adapted to rotate with respect to said housing, and adapted to engage said flow regulator, whereby said flow regulator is opened or closed by rotating said grille with respect to said housing;

a first indicator on a surface of said grille and a second indicator on another component of said diffuser, at least one of said indicators comprising a figure that simulates a graph of the flow rate through said diffuser as a function of the opening of said apertures; whereby said first indicator and said second indicators provide both a visual indication of the position of said regulator and a visual indication of the flow rate through said regulator as said grill rotates with respect to said other component.

2. An air diffuser according to claim 1 wherein said second component comprises a mount that supports said housing in an opening in a floor or other panel.

3. An air diffuser according to claim 1 wherein:

the regulator stops comprise an arm extending inwardly from a first position on a side wall of said flow regulator and a second arm extending inwardly from a second position on said side wall, said first and second arms being connected at a position at or near an axis of revolution of said regulator;

said housing comprises a substantially planar bottom and said housing stop comprises a tab extending from said bottom and positioned between said first and second arms.

4. An air diffuser according to claim 3 further comprising a third arm extending inwardly from a side wall of said flow regulator, said first arm, second arm and third arm being spaced substantially equidistant around said flow regulator and being connected to each other at a location at or near said axis of revolution.

5. An air diffuser according to claim 4:

further comprising a first reinforcing segment extending between said first arm and said third arm, a second reinforcing segment extending between said second arm and said third arm, and a third reinforcing segment extending between said first arm and said second arm, said third reinforcing segment having a smaller axial width than said first and second reinforcing segments;

wherein said tab on said housing is positioned and extends upwardly between said first arm and said second arm.

6. An air diffuser according to claim 1 wherein the apertures in the housing comprise a series of housing slots that extend longitudinally along the side of the housing and are separated from each other by solid sections of the side wall of the housing, said solid sections of said side wall having an arcuate width at least as great as an arcuate width of said housing slots; and the apertures in the flow regulator comprise a series of regulator slots that extend longitudinally along the side wall of said flow regulator and are separated from each other by solid sections of the side wall of said flow regulator, said solid sections having an arcuate width that is substantially at least as great as an arcuate width of said regulator slots.

7. An air diffuser according to claim 1 wherein the housing slots, the solid sections of the side walls of said housing, regulator slots and the solid sections of the side wall of the regulator all have substantially the same arcuate width and are spaced evenly around the side walls of the housing and the flow regulator.

8. An air diffuser according to claim 7 wherein:

the regulator stops comprise an arm extending inwardly from a first portion on a side wall of said flow regulator and a second arm extending inwardly from a second position on the side wall of the regulator, and said first and second arms are connected at a position at or near an axis of resolution of said regulator;

said housing comprises a substantially planar bottom and said housing stop comprises a rib extending from said bottom and positioned between said first and second regulator stops;

the arcuate distance between said first arms and said second arm, less the arcuate width of said housing stop, is substantially equal to the arcuate width of a regulator slot.

9. An air diffuser according to claim 1 wherein said flow regulator comprises pins extending upwardly from said regulator and adapted to enter slots in said grille, whereby said grille engages pins and said flow regulator rotates with said grille.

* * * * *